United States Patent [19]

Cook et al.

[11] Patent Number: 5,048,589

[45] Date of Patent: Sep. 17, 1991

[54] NON-CREPED HAND OR WIPER TOWEL

[75] Inventors: Ronald F. Cook, Marietta, Ga.; Daniel S. Westbrook, Farragut, Tenn.

[73] Assignee: Kimberly-Clark Corporation, Neenah, Wis.

[21] Appl. No.: 452,930

[22] Filed: Dec. 18, 1989

Related U.S. Application Data

[63] Continuation-in-part of Ser. No. 195,234, May 18, 1988, abandoned.

[51] Int. Cl.[5] ..... D21H 11/00; D21H 17/00

[52] U.S. Cl. ..... 162/109; 162/117; 162/147; 162/158; 162/204; 162/207

[58] Field of Search ..... 162/204, 207, 101, 111, 162/117, 109, 309, 362, 359, 158, 179, 147, 100

[56] References Cited

U.S. PATENT DOCUMENTS

| | | | |
|---|---|---|---|
| 3,303,576 | 2/1967 | Sisson . | |
| 3,812,000 | 5/1974 | Salvucci, Jr. et al. . | |
| 3,817,827 | 6/1974 | Benz | 162/113 |
| 3,821,068 | 6/1974 | Shaw . | |
| 3,844,880 | 10/1974 | Meisel et al. | 162/169 |
| 4,072,557 | 2/1978 | Schiel . | |
| 4,093,765 | 6/1978 | Schmidt . | |
| 4,120,747 | 10/1978 | Sarge, III et al. . | |
| 4,166,001 | 8/1979 | Dunning et al. . | |
| 4,189,344 | 2/1980 | Busker . | |
| 4,236,963 | 12/1980 | Busker | 162/271 |
| 4,328,626 | 5/1982 | Leitner . | |
| 4,356,059 | 10/1982 | Hostetler . | |
| 4,361,466 | 11/1982 | Wong et al. . | |
| 4,364,185 | 12/1982 | Dussourd et al. . | |
| 4,420,372 | 12/1983 | Hostetler . | |
| 4,440,597 | 4/1984 | Wells et al. . | |
| 4,461,095 | 7/1984 | Lehtinen . | |
| 4,492,044 | 1/1985 | Knutsen . | |
| 4,523,390 | 6/1985 | McCarthy . | |
| 4,539,762 | 9/1985 | Eskelinen et al. . | |
| 4,556,450 | 12/1985 | Chuang et al. . | |
| 4,632,730 | 12/1986 | Ulubay et al. | 162/158 X |
| 4,688,335 | 8/1987 | Krill et al. . | |
| 4,849,054 | 7/1989 | Klowak | 162/111 X |

OTHER PUBLICATIONS

Abstract Bulletin of the Institute of Paper Chemistry, vol. 55, No. 2, Aug. 1984, p. 188, No. 1667m.

*Primary Examiner*—William A. Powell
*Assistant Examiner*—Thi Dang
*Attorney, Agent, or Firm*—William D. Herrick

[57] ABSTRACT

Hand or wiper towels are made according to a process which includes the steps of: forming a furnish of cellulosic fibers; depositing the furnish on a traveling foraminous belt, thereby forming a fibrous web on top of the traveling foraminous belt; subjecting the fibrous web to non-compressive drying to remove the water from the fibrous web; and removing the dried fibrous web from the traveling foraminous belt. The dried fibrous web is not creped. These hand towels possess superior levels of absorbent capacity, absorbent rate, softness, and strength to other prior art hand or wiper towels with the same or about the same basis weight. Embossing of the hand or wiper towels enhances the superior qualities of the towels. In a preferred embodiment of the present invention, the transfer of the fibrous web from a foraminous belt of a higher speed to a foraminous belt of a lower speed produces a towel with enhanced strength and softness.

18 Claims, 2 Drawing Sheets

NON-CREPED HAND OR WIPER TOWEL

This application is a continuation-in-part of copending U.S. patent application Ser. No. 07/195,234 filed May 18, 1988, now abandoned.

TECHNICAL FIELD

This invention relates to an improved paper towel. More particularly, this invention relates to a more absorbent hand or wiper towel and a process for its manufacture.

BACKGROUND

Disposable paper towels are commonly manufactured and widely used. A primary function of these towels is absorbing liquid. Paper towels posses varying degrees of certain qualities which make them suitable for different tasks. Some of these qualities are softness, absorbent capacity, absorbent rate, and strength. The absorbent capacity is the maximum amount of liquid a paper towel can absorb, and the absorbent rate is the speed with which the paper towel can absorb liquid. The strength of a paper towel is generally the tensile strength of the paper towel which is a measure of the stress required to pull the paper towel apart.

Hand or wiper towels are a particular type of paper towel and are often used in washrooms for drying hands and for cleaning up liquid spills. These towels are also used for wiping surfaces clean with a solvent such as in washing windows or counter tops. Accordingly, towels must absorb relatively large quantities of liquid very quickly and possess enough strength so that they do not break apart when subjected to stress even when the towels are saturated with liquid. Further, it is also desirable for hand or wiper towels to be soft, particularly when the towels are used for drying hands so that they are comfortable to the user's skin and when wiping finished surfaces, such as desk tops or automobile exteriors, so that the towels do not scratch the finished surfaces.

Prior art hand or wiper towels which are made from cellulosic fibers are normally strong even when saturated with liquid, but often lack desirable levels of absorbent capacity, absorbent rate, and softness. These prior art towels are generally made with a conventional wet forming process wherein the beginning furnish contains chemical bonding agents to bind the cellulosic fibers together and promote the strength of the towel. The furnish is deposited on a traveling foraminous belt thereby forming a web of moist cellulosic fibers on top of the foraminous belt. The moist fibrous web is transferred to an absorbent carrier belt and then pressed by one or a series of rollers to remove water from the fibrous web and to compact the fibers in the web to further promote the strength of the towel. The pressed fibrous web is transferred to the outer surface of a rotating steam-heated dryer whereby part of the remaining water is evaporated from the fibrous web. The fibrous web is then "creped" by a blade positioned adjacent the outer surface of the dryer which scrapes the partially-dried fibrous web from the outer surface of the dryer. The creped fibrous web is then conveyed over a series of steam-heated dryers to evaporate the 20–50% moisture remaining in the web after creping. The creping enhances the absorbent capacity and absorbent rate of the towel.

The conventional process for making soft paper towels is similar to the conventional process for making hand or wiper towels; however, creping of the fibrous web is done when moisture content has been reduced to 10% or less. An adhesive solution is also applied to the outer surface of the "Yankee" creping dryer so that the fibrous web adheres tightly to the surface of the dryer. The creped fibrous web requires no further drying in this process. The resulting soft towels possess high levels of absorbent capacity and absorbent rate; however, these soft towels are also very weak and tend to break apart when saturated with liquid. Accordingly, soft paper towels are not an adequate substitute for hand or wiper paper towels.

The creping step in the prior art processes for making hand or wiper towels and soft towels is a particularly costly step in those processes. Due primarily to the abrasiveness of the fibrous webs, the creping blades are quickly dulled and often have to be replaced. In addition to the cost of the replacement blades, there is lost production time when the paper making process must be shut down to replace the blades.

Therefore, there is a need for a hand or wiper paper towel which possesses a high level of strength as well as high levels of absorbent capacity, absorbent rate, and softness.

SUMMARY OF THE INVENTION

The present invention solves the above-described problems in the prior art by providing an improved hand or wiper paper towel. Generally, the present invention is a paper towel prepared by a process which includes the steps of: (1) forming a furnish of cellulosic fibers, water, and a chemical debonder; (2) depositing the furnish on a traveling foraminous belt, thereby forming a fibrous web on top of the traveling foraminous belt; (3) subjecting the fibrous web to noncompressive drying to remove the water from the fibrous web; and (4) removing the dried fibrous web from the traveling foraminous belt. The process of the present invention does not include creping. Surprisingly, the towel of the present invention possesses high levels of absorbent capacity, absorbent rate, strength, and softness. More particularly, the towel of the present invention has an absorbent capacity of at least about 385%, an absorbent rate of about 8 seconds or less, a dry tensile strength of at least about 5700 grams to about 11,000 grams, and a wet tensile strength of at least about 1200 grams to about 1500 grams.

Even more particularly, the towel of the present invention is prepared by a process wherein the cellulosic fibers in the furnish comprise secondary cellulosic fibers. The high levels of absorbent capacity, absorbent rate, strength, and softness are also achieved using the secondary cellulosic fibers. This aspect of the present invention is particularly advantageous because the cost of secondary cellulosic fibers is substantially less than the cost of virgin cellulosic fibers.

Still more particularly, the towel of the present invention is prepared by a process further comprising the step of embossing the dried fibrous web after removing the dried fibrous web from the traveling foraminous belt. The embossing increases the absorbent capacity, absorbent rate, and softness of the web, but tends to reduce the strength of the web. Towels of the present invention prepared by the process including the embossing step have an absorbent capacity of at least about 400%, an absorbent rate of at least about 6 seconds or less, a tensile strength of at least about 1800 grams to about 2700 grams, and a wet tensile strength of at least about 380 grams to about 680 grams.

Still more particularly, the towel of the present invention is prepared by a process which includes the steps of: (1) forming a furnish of cellulosic fibers, water, and a chemical debonder; (2) depositing the furnish on a first traveling foraminous belt, thereby forming a fibrous web on top of the first foraminous belt; (3) transferring the fibrous web from the first traveling foraminous belt to a second foraminous belt traveling at a velocity up to 10% slower than the velocity of the first foraminous belt, thereby providing a series of transverse folds in the fibrous web; (4) subjecting the fibrous web to noncompressive drying to remove water from the fibrous web; and (5) removing the dried fibrous web from the second traveling foraminous belt. The towel made from this particular process exhibits even greater levels of strength and softness because of the series of folds in the towels. The folds increase the strength of the towels by providing a degree of stretch, thereby reducing the tendency of the towel to tear when subjected to stress. The folds in the towels increase the softness of the towels by increasing the thickness of the towel.

The towel of the present invention is achieved without creping the fibrous web. This is a particularly advantageous aspect of the present invention, because the elimination of creping eliminates the high costs inherent in a creping process.

Therefore, an object of the present invention is to provide an improved hand or wiper towel.

Another object of the present invention is to provide a hand or wiper towel with high levels of absorbent capacity, absorbent rate, strength, and softness.

A further object of the present invention is to provide a hand or wiper towel at a reduced cost.

Other objects, features, and advantages will become apparent from reading the following specifications in conjunction with the accompanying drawings.

DETAILED DESCRIPTION OF THE PREFERRED EMBODIMENTS

Figures 1, 2:
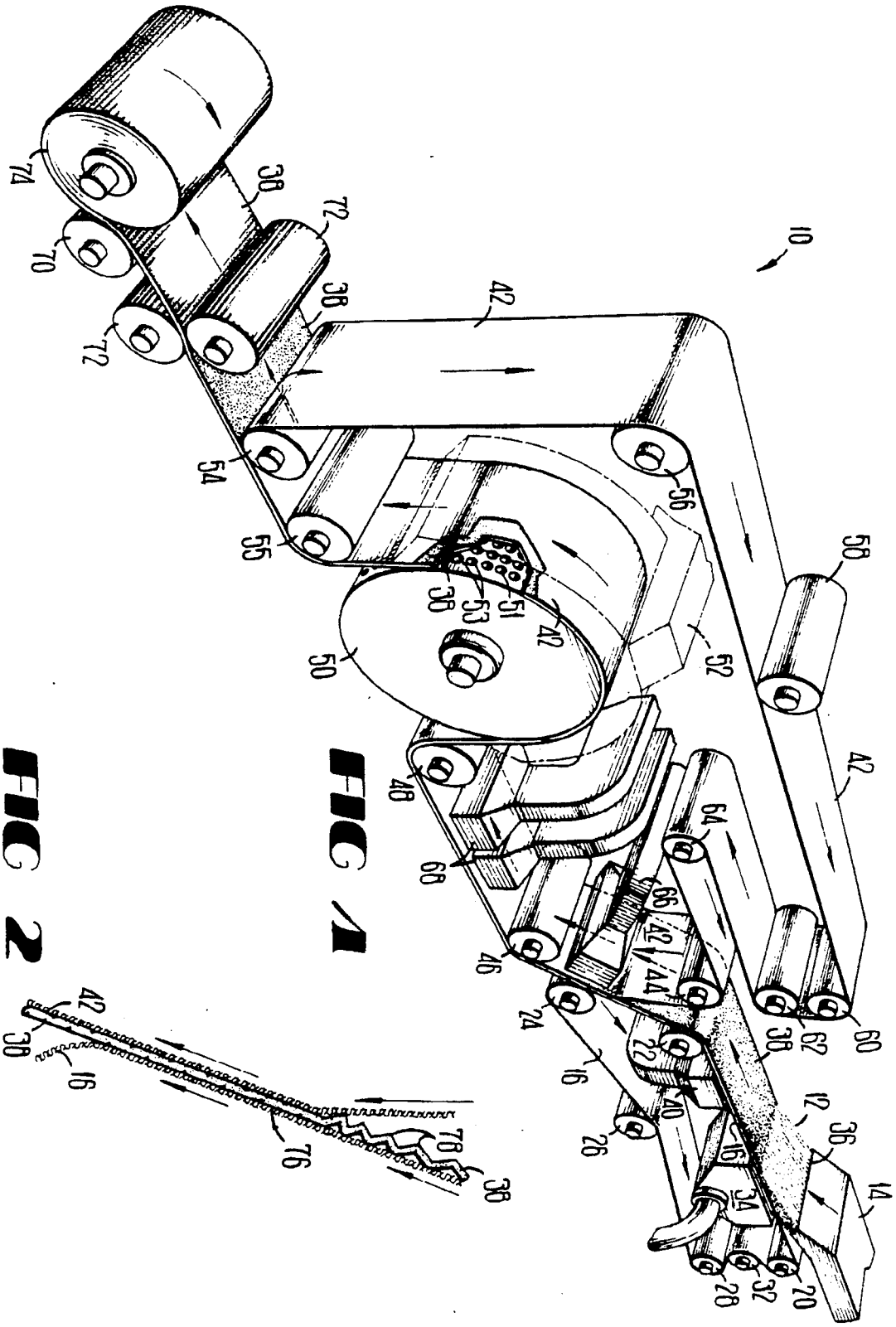
FIG. 1 is a perspective view of a process line for producing a first preferred embodiment of the present invention.
FIG. 2 is an enlarged sectional view of the point of transfer between the forming belt and the through dryer belt in a process line for producing a second preferred embodiment of the present invention.

Turning first to FIG. 1, there is illustrated a process line 10 for producing a first preferred embodiment of the present invention. The process line begins with a paper-making furnish 12 comprising a mixture of secondary cellulosic fiber, water, and a chemical debonder which is deposited from a conventional head box (not shown) through a nozzle 14 on top of a foraminous wire forming belt 16 as shown in FIG. 1. The forming belt 16 travels around a path defined by a series of guide rollers. The forming belt 16 travels from an upper guide roller 20, positioned below and proximate to the head box nozzle 14, horizontally and away from the head box nozzle to another upper guide roller 22, passes over the upper guide roller 22 and diagonally and downwardly to a lower guide roller 24, passes under the lower guide roller 24 and diagonally and upwardly toward the nozzle 14 to a lower guide roller 26, passes over lower guide roller 26 and diagonally and downwardly to lower guide roller 28, passes under lower guide roller 28, and turns upwardly and slightly inwardly to a guide roller 32, passes behind the guide roller 32 and upwardly and outwardly returns to upper guide roller 20.

A vacuum forming box 34 positioned beneath the forming belt 16 proximate the opening 36 of the head box nozzle 14 immediately extracts water from the moist fibrous web 38 deposited on top of the forming belt by the head box nozzle. The partially dewatered fibrous web 38 is carried by the forming belt 16 in the counterclockwise direction, as shown in FIG. 1, towards the upper guide roller 22. The fibrous web 38 as it moves away from the vacuum forming box 34 preferably comprises from about 19% to about 30% cellulosic fiber by weight. An edge vacuum 40 positioned below the forming belt 16 proximate to the upper guide roller 22 is an aid to trimming the edges of the fibrous web 38.

The fibrous web 38 passes over the upper guide roller 22 and downwardly between the forming belt 16 and a through-dryer belt 42.

The through-dryer belt 42 travels around a path defined by a series of guide rollers. The through-dryer belt 42 travels from a guide roller 44 positioned above and vertically offset from guide roller 22 downwardly towards the forming belt 16, contacts the fibrous web 38, and then downwardly and diagonally away from guide roller 24 to guide roller 46, passes under guide roller 46 and turns horizontally away from the forming belt 16 towards a through-dryer guide roller 48, passes under the through-dryer guide roller 48 and turns upwardly and over a through-dryer 50 and downwardly to another through-dryer guide roller 55, passes under through-dryer guide roller 55 and turns horizontally away from the through-dryer 50 towards a lower guide roller 54, passes under lower guide roller 54, and turns upwardly to an upper guide roller 56, passes over the upper guide roller 56 and turns slightly downwardly to an upper guide roller 58, passes under the upper guide roller 58, and turns slightly upwardly in the direction of the forming belt 16 to an upper guide roller 60, passes over upper guide roller 60 and turns downwardly to a guide roller 62, passes under guide roller 62 and turns substantially horizontally away from forming belt 16 to a guide roller 64, passes around guide roller 64 and turns horizontally in the direction of the forming belt 16 and returns to guide roller 44.

A vacuum pickup 66 pulls the fibrous web 38 towards the through-dryer belt 42 and away from forming belt 16 as the fibrous web passes between the through-dryer belt and the forming belt. The fibrous web 38 adheres to the through-dryer belt 42 and is carried by the through-dryer belt downwardly below lower guide roller 46 towards the through-dryer 50. Vacuum boxes 68 positioned above and proximate to the through-dryer belt 42 between the lower guide roller 46 and the through-dryer guide roller 48 further extract water from the moist fibrous web 38. The fibrous web 38 preferably comprises between about 25% and 35% fiber by weight after passing beneath the vacuum boxes 68.

The through-dryer 50 generally comprises an outer rotatable perforated cylinder 51 and an outer hood 52 for receiving the hot air blown through the perforations 53, the fibrous web 38, and the through-dryer belt 42 as is known to those skilled in the art. The through-dryer belt 42 carries the fibrous web 38 over the upper portion of the through-dryer outer cylinder 50. The heated air forced through the perforations 53 in the outer cylinder 51 of the through-dryer 50, removes the remaining water from the fibrous web 38. The temperature of the air forced through the fibrous web 38 by the through-dryer is preferably about 300° to 400° F.

The through-dryer belt 42 carries the dried fibrous web 38 below the through-dryer guide roller 55 towards the lower guide roller 54. The dried fibrous web 38 is pulled from the through-dryer belt at lower guide roller 54 by a takeup roller 70. The dried fibrous web 38 passes from the through-dryer belt 42 to a nip between a pair of embossing rollers 72. The dried and embossed fibrous web 38 then passes from the nip between the embossing rollers 72 to the takeup roller 70 where the fibrous web is wound into a product roll 74.

In an even more preferred embodiment of the present invention, the process line 10 previously described is modified so that the through-dryer belt 42 travels at a velocity up to 10% slower than the velocity of the forming belt 16. Preferably, the through-dryer belt 42 travels at a velocity from about 3 to about 8% slower than the velocity of the forming belt 16. As a result, the moist fibrous web 38 arrives at the point of transfer 76 between the forming belt 16 and the through-dryer belt 42 at a faster rate than the fibrous web is carried away by the through-dryer belt. As the moist fibrous web 38 builds up at the point of transfer 76, the moist fabric tends to bend into a series of transverse folds 78 as shown in FIG. 2. The folds provide for a degree of stretch in the fibrous web thereby increasing the overall strength of the fibrous web, and because the folds stack on top of one another, the fibrous web becomes thicker and thus softer.

Figure 3:
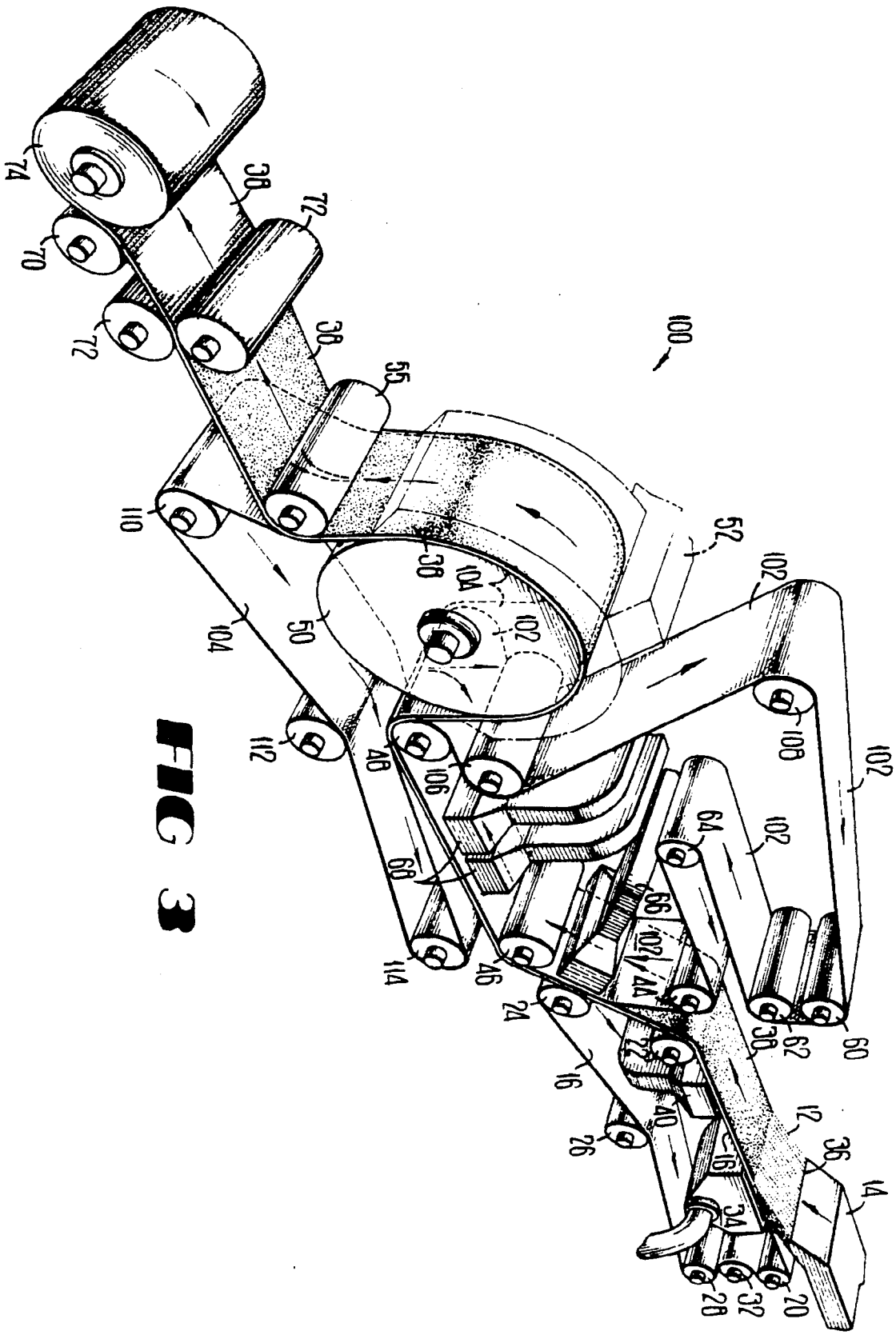
FIG. 3 is a perspective view of a process line for producing a third preferred embodiment of the present invention.

Turning to FIG. 3, there is illustrated a process line 100 for producing a third preferred embodiment of the present invention. The process line 100 in FIG. 3 is the same as the process line 10 in FIG. 1 except that there is a transfer belt 102 and a through-dryer belt 104 in place of the single through-dryer belt 42 shown in FIG. 1. The guide roller and vacuum setup for the transfer belt 102 is the same as that of the upline portion of the through-dryer belt 42 in FIG. 1, except that the transfer belt 102 in FIG. 2 turns upwardly and away from the through-dryer 50 to a guide roller 106, passes under the guide roller 106 and upwardly towards another guide roller 108 passes over the guide roller 108 towards guide roller 60, and then travels the same path as the through-dryer belt 42 in FIG. 1.

The through-dryer belt 104 of the embodiment shown in FIG. 2 passes beneath guide roller 48 and contacts the fibrous web 38, travels from guide roller 48 and over the through-dryer 50, passes under guide roller 55 and downwardly to a guide roller 110 positioned beneath guide roller 55, passes beneath guide roller 110 and travels substantially horizontally to guide roller 112, passes over guide roller 112, and travels substantially horizontally to guide roller 114, passes around guide roller 114, and travels back to guide roller 48.

The vacuum pickup 66 pulls the fibrous web 38 towards the transfer belt 102 and away from the forming belt 16 as the fibrous web passes between the transfer belt and the forming belt. The fibrous web 38 adheres to the transfer belt 102 and is carried by the transfer belt slightly downwardly below guide roller 46 and then substantially horizontally toward guide roller 48. The fibrous web then passes beneath guide roller 48 and is sandwiched between the transfer belt 102 and the through-dryer belt 104. The fibrous web 38 adheres to the through-dryer belt 104 and then is carried by the through-dryer belt over the through-dryer 50. The through-dryer 50 draws heated air through the fibrous web 38 as the fibrous web passes over the through-dryer and drys the fibrous web. The through-dryer belt 104 then carries the dried fibrous web 38 downwardly to guide roller 55 where the fibrous web is pulled from the through dryer belt and carried horizontally towards the pair of embossing rollers 72. As with the embodiment shown in FIG. 1, the dried fibrous web 38 passes through the nip between the embossing roller 72 and is wound about product roll 74.

This invention is further illustrated by the following examples which are illustrative of the preferred embodiments designed to teach those of ordinary skill in the art how to practice this invention.

EXAMPLE 1

A towel is made using the process line 10 shown in FIG. 1. First, initial paper-making furnish is prepared comprising 0.15% by weight of secondary cellulosic fiber and 99.85% water. The secondary cellulosic fiber used in the furnish comprises a mixture of 80% cup stock fiber and 20% deinked wastepaper. 20 wet lbs. of Berocel 584 debonder, a surfactant manufactured by Berolchemie AG, per ton of dry secondary cellulosic fiber is added to the initial furnish mixture. 11.4 dry lbs. of Kymene 557-H wet strength resin, a polyamide epichlorohydrin resin manufactured by Hercules and 500 ml. of Sterox DF, a rewetting agent manufactured by Monsanto, are also added to each dry ton of the initial furnish resulting in a furnish with a Canadian Standard Freeness of 410 cc.

The final furnish is deposited from a head box through a ¼ in. width opening onto a 94 M Appleton forming belt, manufactured by Appleton Wire. The forming belt travels at a velocity of 40 ft. per minute. The deposited furnish forms a web of cellulosic fibers with a dry basis weight of 46 grams per sq. meter on top of the forming belt.

Immediately after the fibrous web is formed on top of the forming belt, the fibrous web passes over a forming box vacuum which operates at a pressure of 8 in. Hg below atmospheric pressure and extracts water from the fibrous web. The fibrous web then passes over an edge vacuum which operates at a vacuum of 11–15 in. Hg below atmospheric pressure and further trims the edges of the fibrous web.

The fibrous web is then transferred to a 31 A Albany through-dryer belt, manufactured by Albany International, with the aid of a vacuum pickup which produces a vacuum of 11–15 in. Hg below atmospheric pressure. The through-dryer belt also travels at a velocity of 40 ft. per minute. The consistency of the partially dewatered fibrous web after the transfer to the through-dryer belt contains 19% by weight of dry cellulosic fiber.

The through-dryer belt carries the partially dewatered fibrous web over a pair of vacuum boxes each producing a vacuum of 14 in. Hg below atmospheric pressure and further dewaters the fibrous web. The through-dryer belt then carries the fibrous web around the upper portion of a cylindrical through-dryer. The fibrous web prior to transfer to the through-dryer comprises 26% to 27% by weight of cellulosic fiber. The through-dryer forces air at a temperature of 335° F. through the fibrous web and removes the remaining water from the fibrous web. The dried fibrous web is pulled directly from the through-dryer belt for use as a hand or wiper towel.

A towel produced according to the specifications in Example 1 was subjected to a series of tests to determine the absorbency and strength of the towel and is indicated in Table 1 as Example 1 base towel. The base towel from Example 1 was also subjected to post-treatment embossing followed by the same series of tests. A portion of the Example 1 base towel was embossed with Kimberly Clark Embossing Pattern 1 (Northern Engraving Pattern No. 1804) and another portion of the Example 1 base towel was embossed with Kimberly Clark Pattern 2 (Northern Engraving Pattern No. 1557). The results of tests performed on the embossed towels is also shown in Table 1. Three prior art hand or wiper towels, the Scott 180, the Fort Howard 202, and the Crown Zellerbach 820, were also subjected to the same tests as the Example 1 base towel. The results of the tests performed on the prior art towels are also shown in Table 1 for comparative purposes.

The basis weight of the towels shown in Table 1 was determined according to ASTM D3776-9 and is shown in units of pounds of dry towel per 2,880 sq. ft. of towel. The absorbent capacity of the towels in Table 1 was measured according to federal specification UU T-595C and is shown as the percent of the weight of the towel which the towel can absorb in weight of water. The absorbent rate of the towels in Table 1 was measured according to TAPPI (Technical Association of the Pulp and Paper Industry) T432 SU-72. The absorbent rate is shown in Table 1 as the number of seconds for a 4"×4" towel to become saturated with water. The thickness of the towel is measured according to TAPPI T411-68 and is shown in inches in Table 1. The tensile strengths of the towels shown in Table 1 are measured according to ASTM D1117-6 and D1682. The tensile strength is the amount of stress required to pull a 3-in. length of towel apart. The tensile strengths shown in Table 1 are expressed in grams. The tensile strengths of dry towels were measured in both the machine direction and the cross direction. The tensile strengths of the towels saturated with water were measured in the cross direction.

TABLE 1

| | Scott 180 | Fort Howard 202 | Crown Zellerbach 820 | Example 1 Base Towel | Embossed Base Towel K-C Pat. 1 | Embossed Base Towel K-C Pat. 2 |
|---|---|---|---|---|---|---|
| Basis Weight, #/2880 ft$^2$ | 27 | 27 | 25 | 27 | 27 | 27 |
| Absorbent Capacity, % | 284 | 270 | 295 | 385 | 399 | 505 |
| Absorbent Rate, Seconds | 35 | 58 | 69 | 8 | 6 | 4 |
| Thickness, Inches | 0.0042 | 0.0043 | 0.0046 | 0.0077 | 0.0083 | 0.0093 |
| Tensile Strength | | | | | | |
| MD Dry, g | 7480 | 6690 | 6690 | 10890 | 6078 | 2679 |
| CD Dry g | 3460 | 3470 | 2640 | 5738 | 2421 | 1889 |
| CD Wet g | 1163 | 750 | 800 | 1481 | 673 | 387 |

As shown in Table 1, the Example 1 base towel possesses a superior absorbent capacity to other hand or wiper towels which comprise the same or about the same basis weight as the Example 1 base towel. The absorbent capacity of the Example 1 base towel as shown in Table 1 is 90% greater than any of the prior art towels also shown. The Example 1 base towel also possesses a superior level of absorbent rate when compared to the prior art towels shown therein. The absorbent rate of the Example 1 base towel is at least 4 times faster than any of the prior art towels shown in Table 1. The Example 1 base towel also possesses a greater thickness than those prior art towels shown in Table 1 and thus is a softer towel. Further, the tensile strength of the Example 1 base towel is superior to the tensile strengths of the prior art towels shown in Table 1.

The embossed Example 1 base towels possess even higher levels of absorbent capacity and absorbent rate as shown in Table 1. The tensile strengths of the embossed Example 1 base towels are reduced somewhat by the embossing but remain comparable to the tensile strengths of the prior art towels shown in Table 1.

EXAMPLE 2

A towel is made using the process line shown in FIG. 3. First, as in Example 1, an initial furnish is prepared containing 0.15% by weight cellulosic fiber and 99.85% water. The cellulosic fiber used comprises a mixture of 75% by weight secondary fiber and 25% virgin northern hardwood. Eight to ten pounds of Kymene 557H wet strength resin is also added per dry ton of cellulosic fiber.

The furnish is deposited from a headbox through a 1¼" to 1½" opening onto an Aston 856 forming belt, manufactured by Aston Fabrics. The belt travels at a speed of 750 feet per minute. The deposited furnish forms a web of cellulosic fiber with a dry basis weight of 46 grams per square meter on top of the forming belt.

The fibrous web immediately passes over a series of vacuums which operate at 8 in Hg below atmospheric pressure, extracting water from the fibrous web. The web is then trimmed to the proper width using standard water jets manufactured for such purpose.

The web is then transfered to as Asten 920 transfer belt, with the aid of a vacuum pickup, producing a vacuum of 12–15 in Hg below atmospheric pressure. The transfer belt also travels at 750 feet per minute. The partially dewatered fibrous web contains 25–28% by weight cellulosic fiber after transfer to the transfer belt.

The transfer belt carries the partially dewatered webs under a pair of vacuum slots operating at vacuums of 12" Hg and 20" Hg below atmospheric pressure, further dewatering the fibrous web.

The web is then transferred to a through-drier belt, also being an Asten 920 fabric. The through dryer belt operates at 750 feet per minute and carries the fibrous web around the upper portion of a cylindrical through dryer. The through dryer forces air through the sheet at temperatures between 380° F. and 400° F., removing the remaining water from the web. The dried fibrous web is then pulled from the through dryer belt for use as a hand or paper towel.

A towel produced according to the specifications in Example 2 was subjected to the same series of tests as the towel from Example 1 and was also subjected to some additional tests. The results of these tests are shown in Table 2 under Example 2 base towel. The base towel from Example 2 was also subjected to post-treatment embossing followed by the same series of tests. A portion of the Example 2 base towel was embossed with Kimberly-Clark embossing pattern 1 (Northern Engraving Pattern No. 1804). The results of tests performed on the embossed towel is also shown in Table 2. A Bounty soft paper towel manufactured by Proctor & Gamble was also subjected to the same tests as the Example 2 base towel, and results of those tests are shown in Table 2 for comparative purposes. The data from the tests performed on the Scott 180 and Fort Howard 202 towels shown in Table 1 is also shown in Table 2 along with some additional test data for comparative purposes.

The wicking rate of the towels shown in Table 2 was determined according to the following procedure and is shown in units of centimeters. The wicking rate is the distance water travels through the towels via capillary action after 60 seconds. In the wicking rate test, five towel samples measuring 1×6 inches were cut in a diagonal pattern across the width of the sample material, with the long dimension parallel to the machine direction. 200 ml. of deionized water was poured into a 250 ml. beaker. A small amount of red dye was added to the water to improve visibility. The water-filled beaker was placed on the base of a ring stand. A steel ruler was vertically mounted to the ring stand with a clamp so that the lower edge of the ruler coincided with the surface of the water in the beaker. A cut towel sample was clamped to the ruler with the long dimension of the sample positioned vertically. The sample height was adjusted so that the lower edge of the sample when released would extend one inch into the water. The lower edge of the sample was released and the height in centimeters of the lowest point of complete saturation of the sample was measured 60 seconds after the lower edge of the sample was released. The remaining five samples were measured according to the foregoing procedure and the average height of migration of the water after 60 seconds was determined. This average height is the value shown in Table 2.

The crush of the towels shown in Table 2 was measured according to the following procedure and is shown in units of grams. The crush is an indication of the softness of a towel and the lower the crush value, the softer the towel. This procedure was conducted in a controlled environment wherein the temperature was about 73° F. and the relative humidity was about 50%. Paper towel samples were tested using a Material Test Instrument and Crush Test Stand available from Kimberly-Clark Corporation Quality Assurance Department in Neenah, Wis. The Material Test Instrument and Crush Test Stand included a model 11 foot, a model 21 forming cylinder, a model 31 steel ring, a model 41 forming cup, a calibration set and an Epson FX-86e printer with cable.

The steel ring was placed over the forming cylinder and a 9×9 inch paper towel sample was centered over the forming cylinder. The forming cylinder was inserted into the forming cup until the sample was pinched between the forming cylinder and the steel ring all the way around the steel ring. The forming cup was placed on top of the cylinder plate of the load cell and firmly seated over the ridge of the cylinder plate. The foot was mechanically lowered into the forming cup crushing the sample while the Materials Test Instrument measured the peak load needed to crush the sample.

The MD stretch of the towels shown in Table 2 was measured according to ASTM D1117-6 and D-682. The MD stretch is shown as a percentage of stretch of the towels reached before the towel is pulled apart.

As shown in Table 2, the Example 2 base towel possesses an absorbent capacity superior to the Scott 180 and Fort Howard 202 towels which have the same basis weight as the Example 2 base towel. The Example 2 base towel also possesses a superior level of absorbent rate and wicking rate than the Scott 180 or Fort Howard 202 towels. The Example 2 base towel also possesses a greater thickness than the Scott 180 or Fort Howard 202 towels and a crush value comparable to the Scott 180 and Fort Howard 202 towels, and is thus a softer towel. Further, the tensile strength of the Example 2 base towel is substantially equal or superior to the tensile strength of the Scott 180 or Fort Howard 202 towels.

The thickness, and thus the softness, of the Example 2 base towel is comparable to the Bounty soft paper towel. Although the Example 2 base towel possesses a lower absorbent capacity, absorbent rate and wicking rate than that of the Bounty paper towel, the Example 2 base towel possesses far superior tensile strength when compared to that of the Bounty paper towel. Although the tensile strengths of the embossed Example 2 base towel are reduced somewhat by the embossing, the embossed Example 2 base towel possesses a higher level of absorbent capacity.

TABLE 2

| | Scott 180 | Fort Howard 202 | Proctor & Gamble Bounty | Example 2 Base Towel | Embossed Base Towel K-C Pat. 1 |
|---|---|---|---|---|---|
| Basis Weight, #/2880 ft$^2$ | 27 | 27 | 27 | 27 | 27 |
| Absorbent Capacity, % | 284 | 270 | 920 | 435 | 515 |
| Absorbent Rate, Seconds | 35 | 58 | 1 | 4 | 4 |
| Wicking Rate cm at 60 sec. | 3.1 | 2.0 | 5.1 | 5.0 | 5.0 |
| Thickness, Inches | 0.0042 | 0.0043 | 0.0108 | 0.0113 | 0.0092 |
| Crush, g | 415 | 444 | 186 | 447 | 327 |
| Tensile Strength | | | | | |

TABLE 2-continued

| | Scott 180 | Fort Howard 202 | Proctor & Gamble Bounty | Example 2 Base Towel | Embossed Base Towel K-C Pat. 1 |
|---|---|---|---|---|---|
| MD Dry g | 7480 | 6690 | 2520 | 6440 | 2560 |
| CD Dry g | 3460 | 3470 | 2220 | 5870 | 2420 |
| CD Wet g | 1163 | 750 | 895 | 1700 | 820 |
| MD Stretch % | 6.6 | 4.5 | 20.0 | 4.5 | 3.0 |

In summary, the data in Tables 1 and 2 show that hand or wiper towels which are preferred embodiments of the present invention possess a superior combination of absorbent capacity, absorbent rate, softness and strength when compared to other prior art hand or wiper towels of the same or about the same basis weight. It should be understood that the advantageous qualities of the hand or wiper towels which are preferred embodiments of the present invention are achieved without a creping step.

It should also be understood that the foregoing relates only to preferred embodiments of the present invention, and that numerous changes and modifications may be made without departing from the spirit and scope of the invention as defined in the following claims.

We claim:

1. A towel having an absorbent capacity of at least about 385%, and an absorbent rate of about 8 seconds or less, prepared by a process comprising the steps of:

forming a furnish of cellulosic fibers, water, and a chemical debonder;

depositing the furnish on a first traveling foraminous belt thereby forming a fibrous web on top of the traveling foraminous belt;

subjecting the fibrous web to non-compressive drying to remove the water from the fibrous web; and removing the dried fibrous web from the traveling foraminous belt without creping the fibrous web.

2. The towel prepared by a process as in claim 1, wherein:

the cellulosic fibers in the furnish comprise secondary cellulosic fibers.

3. The towel prepared by a process as in claim 2, wherein:

the non-compressive drying is achieved with a through-dryer.

4. The towel prepared by a process as in claim 3, wherein:

the towel has a dry tensile strength of at least about 5700 grams, and a wet tensile strength of at least about 1200 grams.

5. The towel prepared by a process as in claim 1, further comprising the step of:

embossing the dried fibrous web after removing the dried fibrous web from the traveling foraminous belt.

6. The towel prepared by a process as in claim 5, wherein:

the cellulosic fibers in the furnish comprise secondary cellulosic fibers.

7. The towel prepared by a process as in claim 6, wherein:

the non-compressive drying is achieved with a through-dryer.

8. The towel prepared by a process as in claim 7, wherein:

the towel has an absorbent capacity of at least about 400%, an absorbent rate of about 6 seconds or less, a dry tensile strength of at least about 1800 grams to about 2700 grams, and a wet tensile strength of at least about 380 grams to about 680 grams.

9. A towel prepared by a process as in claim 1, wherein:

the first foraminous belt travels at a first velocity; and further comprising the step of, transferring the fibrous web from the first traveling foraminous belt to a second foraminous belt, the second foraminous belt traveling at a second velocity up to about 10% slower than the first velocity, thereby providing a series of transverse folds in the fibrous web prior to subjecting the fibrous web to non-compressive drying.

10. The towel prepared by a process as in claim 9, wherein:

the cellulosic fibers in the furnish comprise secondary cellulosic fibers.

11. The towel prepared by a process as in claim 10, wherein:

the non-compressive drying is achieved with a through-dryer.

12. The towel prepared by a process as in claim 11, further comprising the step of:

embossing the dried fibrous web after removing the dried fibrous web from the second traveling foraminous belt.

13. A towel having an absorbent capacity of at least about 400%, an absorbent rate of about 6 seconds or less, a dry tensile strength of at least about 1800 grams, and a wet tensile strength of at least about 380 grams prepared by a process comprising the following steps performed in sequence:

forming a furnish of cellulosic fibers, water, and a chemical debonder;

depositing the furnish on a first traveling foraminous belt thereby forming a fibrous web on top of the traveling formainous belt;

subjecting the fibrous web to non-compressive drying to remove the water from the fibrous web;

removing the dried fibrous web from the traveling foraminous belt without creping; and embossing the dried fibrous web.

14. The towel prepared by a process as in claim 13, wherein:

the cellulosic fibers in the furnish comprise secondary cellulosic fibers.

15. The towel prepared by a process as in claim 14, wherein:

the non-compressive drying is achieved with a through-dryer.

16. A towel having an absorbent capacity of at least about 400%, an absorbent rate of about 6 seconds or less, a dry tensile strength of at least about 1800 grams and a wet tensile strength of at least about 380 grams prepared by a process comprising the following steps performed in sequence:

forming a furnish of cellulosic fibers, water and a chemical debonder;

depositing the furnish on a first foraminous belt, the first foraminous belt traveling at a first velocity, thereby forming a fibrous web on top of the first foraminous belt;

transferring the fibrous web from the first traveling foraminous belt to a second foraminous belt, the second foraminous belt traveling at a second velocity up to about 10% slower than the velocity of the first foraminous belt, thereby providing a series of transverse folds in the fibrous web;

subjecting the fibrous web to non-compressive drying to remove the water from the fibrous web;

removing the dried fibrous web from the second traveling foraminous belt without creping; and embossing the dried fibrous web.

17. The towel prepared by a process as in claim 16, wherein:

the cellulosic fibers in the furnish comprise secondary cellulosic fibers.

18. The towel prepared by a process as in claim 17, wherein:

the non-compressive drying is achieved with a through-dryer.

* * * * *

UNITED STATES PATENT AND TRADEMARK OFFICE

CERTIFICATE OF CORRECTION

PATENT NO. : 5,048,589

DATED : September 17, 1991

INVENTOR(S) : Ronald F. Cook and Daniel S. Westbrook

It is certified that error appears in the above-identified patent and that said Letters Patent is hereby corrected as shown below:

Column 1, line 17, "posses" should read --possess--;

Column 8, line 37, "transfered to as Asten" should read --transferred to an Aston--;

Column 8, line 64, "through-drier" should read --through-dryer--;

Column 8, line 65, "Asten" should read --Aston--;

Column 8, line 65, "through dryer" should read --through-dryer--;

Column 8, lines 67-68, "through dryer" should read --through-dryer--;

Column 8, line 68, "through dryer" should read --through-dryer--;

Column 9, line 3, "through dryer" should read --through-dryer--.

Signed and Sealed this

Thirteenth Day of July, 1993

*Attest:*

Michael K. Kirk

MICHAEL K. KIRK

*Attesting Officer*

*Acting Commissioner of Patents and Trademarks*